US011007451B2

(12) United States Patent
Temple, Jr.

(10) Patent No.: US 11,007,451 B2
(45) Date of Patent: May 18, 2021

(54) INTERACTIVE CHARACTER CONTROL SYSTEM

(71) Applicant: Universal City Studios LLC, Universal City, CA (US)

(72) Inventor: Ricky Recardo Temple, Jr., Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 0 days.

(21) Appl. No.: 16/682,998

(22) Filed: Nov. 13, 2019

(65) Prior Publication Data

US 2020/0222824 A1 Jul. 16, 2020

Related U.S. Application Data

(60) Provisional application No. 62/790,814, filed on Jan. 10, 2019.

(51) Int. Cl.
*A63H 33/00* (2006.01)
*A63J 19/00* (2006.01)

(52) U.S. Cl.
CPC ..... *A63J 19/006* (2013.01)

(58) Field of Classification Search
CPC ..... A63H 33/00; A63H 7/00; A41D 15/00; A41D 15/04; A41D 2300/324
USPC ..... 446/26–28; 2/88, 102
See application file for complete search history.

(56) References Cited

U.S. PATENT DOCUMENTS 3,390,481 A 7/1968 Runanin
4,660,033 A 4/1987 Brandt
4,825,136 A 4/1989 Farhat
5,289,273 A 2/1994 Lang
5,493,185 A 2/1996 Mohr et al.
5,845,540 A 12/1998 Rosheim
6,016,385 A 1/2000 Yee et al.
6,198,247 B1 3/2001 Barr
6,377,281 B1 4/2002 Rosenbluth et al.
6,500,041 B1 * 12/2002 Crome, Jr. ..... A42B 1/004 2/195.1
7,175,496 B1 * 2/2007 Lund ..... A63J 7/005 2/88
7,192,152 B1 * 3/2007 Hesse ..... A63B 71/06 2/905

(Continued)

FOREIGN PATENT DOCUMENTS

CN 102728074 A 10/2012
CN 102800117 A 11/2012

(Continued)

OTHER PUBLICATIONS

PCT/US2020/012124 International Search Report and Written Opinion dated Apr. 8, 2020.

*Primary Examiner* — Kien T Nguyen
(74) *Attorney, Agent, or Firm* — Fletcher Yoder, P.C.

(57) ABSTRACT

Provided herein is a character control system includes a strap configured to removably couple to a prop of a performer. A controls assembly is disposed within a portion of the strap. The controls assembly includes a plurality of control features. A controller is configured to couple to the controls assembly and an actuator of a puppet. The controller is configured to control the actuator to move a part of the puppet in response to actuation of a control feature of the plurality of control features by the performer.

19 Claims, 4 Drawing Sheets

(56) References Cited

U.S. PATENT DOCUMENTS

| | | | | |
|---|---|---|---|---|
| 8,444,031 | B2 * | 5/2013 | Bonnet | A45F 3/10 224/265 |
| 2005/0148279 | A1 | 7/2005 | Maa | |
| 2005/0153624 | A1 | 7/2005 | Wieland et al. | |
| 2008/0173686 | A1 * | 7/2008 | Kennedy | A63J 7/00 224/600 |
| 2009/0280715 | A1 * | 11/2009 | Palmeiri | A63J 7/005 446/28 |
| 2010/0144239 | A1 | 6/2010 | Eck et al. | |
| 2013/0130585 | A1 | 5/2013 | Eck et al. | |
| 2015/0289572 | A1 * | 10/2015 | Conde | A41D 1/00 446/26 |

FOREIGN PATENT DOCUMENTS

| | | | |
|---|---|---|---|
| CN | 202605745 | U | 12/2012 |
| GB | 2505212 | | 2/2014 |
| JP | H05237269 | A | 9/1993 |

* cited by examiner

INTERACTIVE CHARACTER CONTROL SYSTEM

CROSS REFERENCE TO RELATED APPLICATIONS

This application claims priority from and the benefit of U.S. Provisional Application Ser. No. 62/790,814, entitled "INTERACTIVE CHARACTER CONTROL SYSTEM," filed Jan. 10, 2019, which is hereby incorporated by reference in its entirety for all purposes.

BACKGROUND

The present disclosure relates generally to control systems and, more specifically, to an interactive character control system.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Generally, puppets, characters, and/or other creatures may appear to move via actions of a performer, such as a puppeteer, and/or through mechanical actuators. In some cases, movement of the puppeteer may generate corresponding movement of the puppet, character, and/or creature, which may generate an illusion or impression that the puppet, character, and/or creature is alive. Similarly, actuators, motors, and/or other drives may be utilized to cause movement of the puppet, character, and/or creature in addition to, or in lieu of, movement of the performer. In some cases, movement of the puppet, character, and/or creature may be limited by the ability of the performer. Additionally or alternatively, an audience viewing the puppet, character, and/or creature may notice a performer controlling the actuators, motors, and/or drives, thereby reducing a sense of realness of the puppet, character, and/or creature.

SUMMARY

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In an embodiment, a character control system includes a strap configured to removably couple to a prop of a performer, a controls assembly disposed within a portion of the strap, where the controls assembly comprises a plurality of control features, and a controller configured to couple to the controls assembly and an actuator of a puppet, wherein the controller is configured to control the actuator to move a part of the puppet in response to actuation of a control feature of the plurality of control features.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
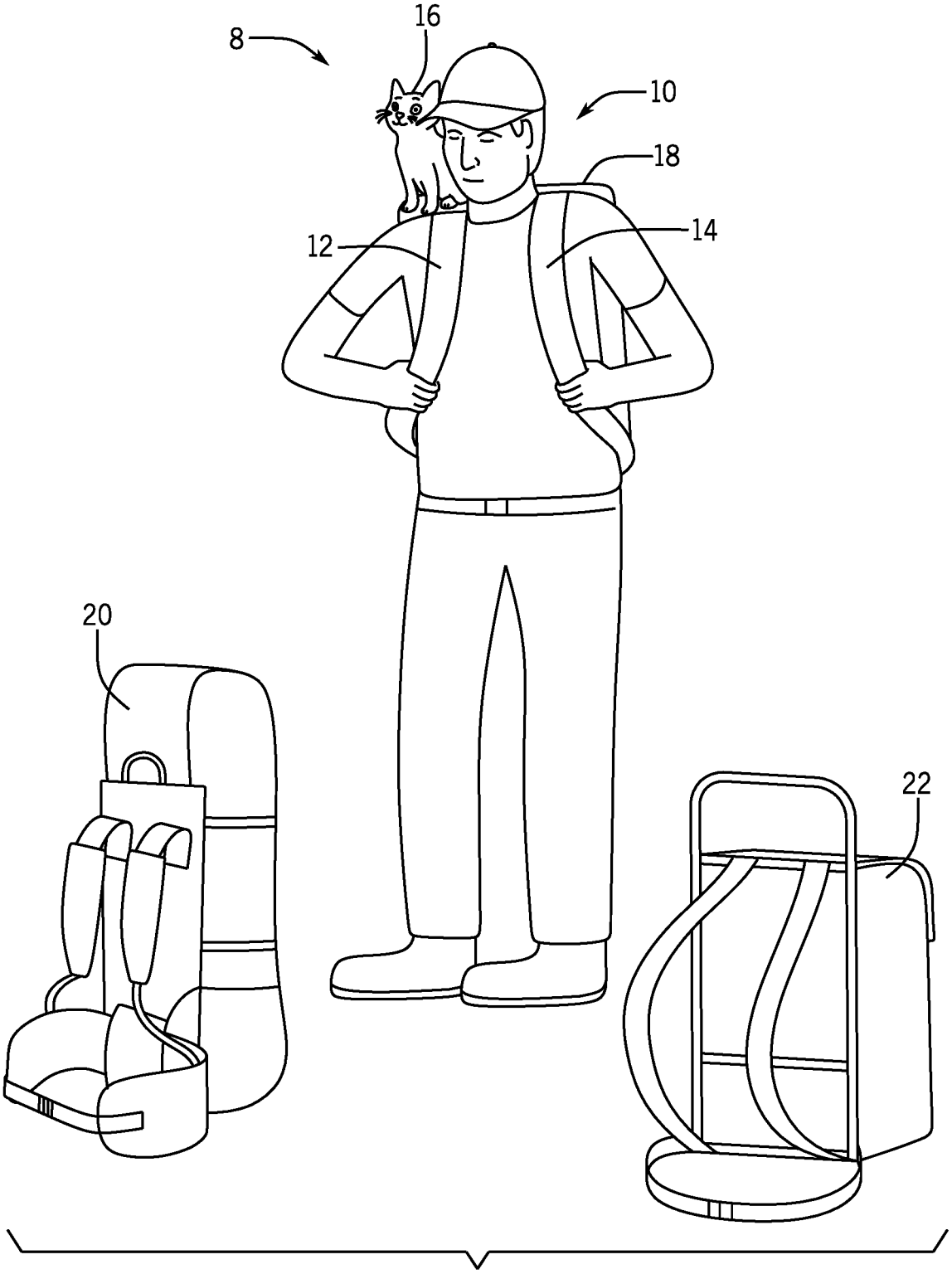
FIG. 1 is a perspective view of an embodiment of a character control system, in accordance with aspects of the present disclosure.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Utilizing puppets or other automated figures (e.g., characters) may provide an illusion that an otherwise fictional character or creature is alive or active. For example, a performer may cause movement of a puppet via movement of the performer. The performer may move features of the puppet (e.g., a head, arms, legs, and/or mouth) to mimic or act out movement of the puppet and generate an illusion that the puppet is alive. Additionally or alternatively, the puppet may be controlled via actuators, motors, and/or other drives that cause movement of the puppet either remotely or by a performer in close proximity to the puppet. Unfortunately, movement of the puppet caused by the performer may be limited because the performer may only control certain portions or parts of the puppet. Additionally, in some cases, audience members may recognize that the performer is directing the movement of the puppet either via movement of the performer or via controls associated with an actuator. It should be noted that the terms character, puppet, animatronic, and automated figure are interchangeably utilized throughout this disclosure to reference puppets or other figures that may have their movement controlled to provide an illusion of autonomous movement.

As such, embodiments of the present disclosure are directed toward an improved character control system that may conceal a performer's ability to control and/or actuate control of movement of a puppet. For instance, the present disclosure relates to control straps that may be utilized by a performer to actuate movement of a puppet. The control straps may be concealed as part of a costume or uniform of the performer, such that audience members do not easily recognize that the performer is controlling movement of the puppet. As a non-limiting example, the control straps may be used as part of a backpack that the performer wears and is consistent with a theme of the puppet being controlled. The control straps may include controllers coupled to actuators that drive movement of the puppet and/or cause the puppet to output audio to the audience members. Further still, the control straps may be interchangeable with multiple different puppets and/or multiple different costumes of the performer. As such, the controls straps are not limited to a single puppet, theme, or costume, which may reduce costs of the character control system.

Turning to the drawings, FIG. 1 is a perspective view of an embodiment of a character control system 8 utilized by a performer 10. The character control system 8 may include a first control strap 12 and a second control strap 14 that the performer 10 interacts with to control a puppet 16. As shown in the illustrated embodiment of FIG. 1, the first control strap 12 and the second control strap 14 are utilized as straps of a backpack 18 worn by the performer 10. While the present discussion focuses on utilizing the first control strap 12 and the second control strap 14 as straps for the backpack 18, it should be recognized that the first control strap 12 and the second control strap 14 may be utilized as any other suitable prop or portion of a costume and/or uniform that may be consistent with a theme of the puppet 16 (e.g., suspenders, overalls, lapels, and/or other suitable straps).

The first control strap 12 and the second control strap 14 may be utilized to control movement of the puppet 16 and/or output audio from the puppet 16. For example, the first control strap 12 and the second control strap 14 may each include buttons, joysticks, control pads, touch pads, and/or other interactive features that may enable the performer 10 to control movement of the puppet 16 and/or output audio from the puppet 16. As set forth above, the first control strap 12 and the second control strap 14 may be interchangeable with other costumes, props, and/or uniforms that are consistent with a theme of the respective puppet 16. For instance, the first control strap 12 and the second control strap 14 may be disconnected from the backpack 18 and coupled to a second backpack 20 and/or a third backpack 22. Additionally or alternatively, the puppet 16 may be interchangeable with the first control strap 12, the second control strap 14, and/or the backpack 18. Therefore, the first control strap 12 and the second control strap 14 may be utilized with a variety of different costumes, props, and/or uniforms of the performer 10, as well as with a variety of different puppets 16. Thus, the character control system 8 is versatile and reduces costs because of the interchangeability of the first control strap 12 and the second control strap 14.

Figure 2:
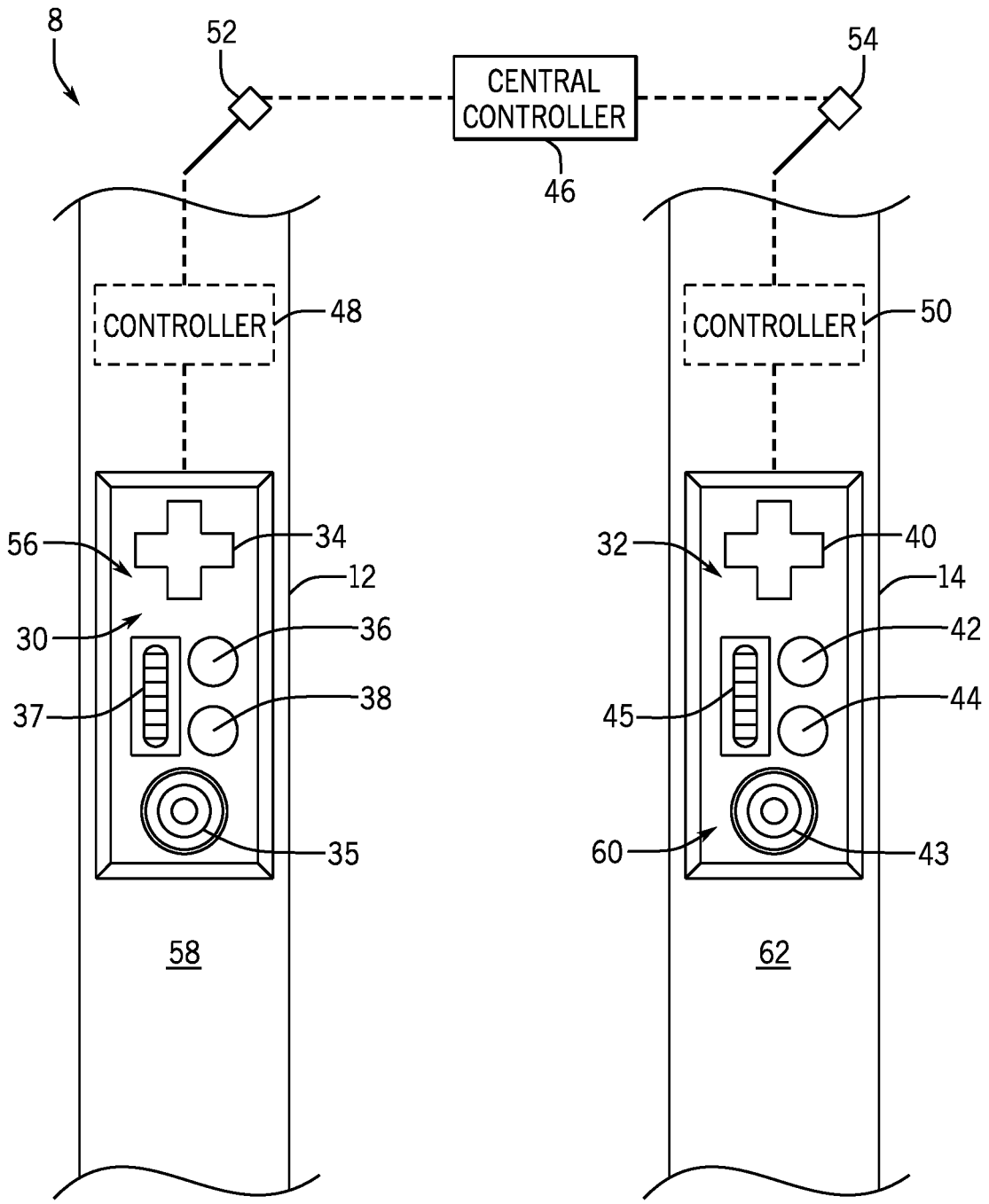
FIG. 2 is a schematic of an embodiment of straps of the character control system, in accordance with aspects of the present disclosure.

In some embodiments, the first control strap 12 and the second control strap 14 include various control features that enable the performer 10 to control the puppet 16. For instance, FIG. 2 is a schematic diagram of an embodiment of the first control strap 12 and the second control strap 14. As shown in the illustrated embodiment of FIG. 2, the first control strap 12 may include a first controls assembly 30 and the second control strap 14 may include a second controls assembly 32. The first controls assembly 30 may include a control pad 34, a first button 36, a second button 38, a joystick 35, and/or a control wheel 37. Each of the control pad 34, the first button 36, and the second button 38 may actuate a different movement, sound, and/or other effect to be performed by the puppet 16. It should be recognized that the first controls assembly 30 may include more than one of the control pads 34 and any suitable number of buttons (e.g., 1, 3, 4, 5, 6, 7, 8, 9, 10, or more than 10 buttons). Additionally, the second controls assembly 32 may include a control pad 40 (e.g., a second control pad), a third button 42, a fourth button 44, a joystick 43, and/or a control wheel 45. Each of the control pad 40, the third button 42, and the fourth button 44 may actuate a different movement, sound, and/or other effect to be performed by the puppet 16. Similar to the first controls assembly 30, it should be recognized that the second controls assembly 32 may include more than one of the control pads 40 and any suitable number of buttons (e.g., 1, 3, 4, 5, 6, 7, 8, 9, 10, or more than 10 buttons). In some embodiments, the first controls assembly 30 and the second controls assembly 32 may be essentially identical and provide the same controls, which may be beneficial because it will provide redundancy in the event of a failure.

In some embodiments, the control pad 34 may be utilized to adjust a position of a head, eyes, ears, arms, fingers, legs, toes, wings, torso, tail, and/or mouth of the puppet 16. In some embodiments, the first button 36 and/or the second button 38 may enable the performer 10 to switch control of the control pad 34 between various parts of the puppet 16. For example, the performer 10 may press the first button 36 to enable the control pad 34 to adjust a position of a head of the puppet 16 and press the second button 38 to adjust a position of arms of the puppet 16. In other embodiments, the first controls assembly 30 may control a first portion (e.g., the head) of the puppet 16 and the second controls assembly 32 may control a second portion (e.g., arms and/or legs) of the puppet 16. In still further embodiments, the first controls assembly 30 may control linear movement of a portion of the puppet 16 and the second controls assembly 32 may control rotational movement of the portion of the puppet 16. Additionally or alternatively, the buttons 36, 38, 42, 44 may be utilized to output audio from the puppet 16. Further still, the buttons 36, 38, 42, 44 may be pressed in various combinations and/or simultaneously to cause the puppet 16 to move, emit a sound, and/or perform another suitable effect. Therefore, the performer 10 may be able to control multiple portions or parts of the puppet 16 using a limited amount of control features (e.g., the control pads 34, 40 and/or the buttons 36, 38, 42, 44) of the first controls assembly 30 and the second controls assembly 32. It should be recognized, that the control pad 34, the first button 36, the second button 38, the control pad 40, the third button 42, and/or the fourth button 44 may be utilized to control any suitable movement and/or audio of the puppet 16. In some embodiments, various movement and/or audio subroutines may be preprogrammed for performance in response to certain actuations or series of actuations of one or both of the first and second control assemblies 30, 32.

In some cases, the performer 10 may interact with the audience and/or otherwise utilize their hands, such that the performer 10 is not able to control movement of the puppet 16 via the first controls assembly 30 and/or the second controls assembly 32. Accordingly, the first controls assembly 30 and/or the second controls assembly 32 may provide the performer 10 with an ability to place the puppet 16 in an idle state, where movement of the puppet 16 follows a predetermined or preprogrammed sequence. The idle state may be defined as a state of control that is entered by control aspects (e.g., controllers 48, 50) of the character control system 8 upon activation by a user and/or after a threshold time of inactivity (e.g., no actuation of the first and/or second controls assembly 30, 32 for a period of 30 seconds). For example, the performer 10 may press the first button 36 to place the puppet 16 into the idle state and enable the puppet 16 to move without further interaction by the performer 10 with the first controls assembly 30 and/or the second controls assembly 32. Additionally or alternatively, a central controller 46 of the character control system 8 may detect that the performer 10 has not engaged the first controls assembly 30 and/or the second controls assembly 32 within a predetermined time interval (e.g., 10 seconds, 20 seconds, 30 seconds) and automatically place the puppet 16 in the idle state. In any case, the puppet 16 may move and generate an illusion that the puppet 16 is alive without the performer interacting with the first controls assembly 30 and/or the second controls assembly 32 when in the idle state.

As shown in the illustrated embodiment of FIG. 2, the first control strap 12 may include a first controller 48 and the second control strap 14 may include a second controller 50. The controllers may include servo controllers that are configured to adjust actuators within the puppet 16 to cause movement of the puppet 16. Additionally, the controllers 48, 50 may actuate a speaker and/or visual effect device of the puppet 16 to output audio and/or another visual effect from the puppet 16. The first controller 48 is communicatively coupled to the first controls assembly 30, and thus, directs movement of the puppet 16 when the performer 10 interacts with the first controls assembly 30. Similarly, the second controller 50 is communicatively coupled to the second controls assembly 32, and thus, directs movement of the puppet 16 when the performer 10 interacts with the second controls assembly 32. In some embodiments, the first controller 48 and/or the second controller 50 may both be coupled to the central controller 46. In other embodiments, the character control system 8 may not include the central controller 46.

The first controller 48 and the second controller 50 may be removably coupled to the puppet 16, the central controller 46, and/or a prop (e.g., the backpack 18) via a first connector 52 and a second connector 54, respectively. Therefore, the first control strap 12 and the second control strap 14 may be interchangeable between multiple puppets 16 and/or props. In some embodiments, the control features (e.g., the control pads 34, 40 and/or the buttons 36, 38, 42, 44) of the first controls assembly 30 and/or the second controls assembly 32 may adjust different portions or parts of different puppets 16 depending on the type of puppet. The first connector 52 and the second connector 54 may enable the first controller 48 and the second controller 50, respectively, to couple to various actuators disposed within the puppet 16 and/or the prop (e.g., the backpack 18). Therefore, interaction with the first controls assembly 30 and the second controls assembly 32 causes movement, audio output, and/or another effect to be performed by the respective puppet 16 coupled to the first control strap 12 and the second control strap 14.

In some embodiments, the first control strap 12 and the second control strap 14 may be utilized as straps for the backpack 18. The first controls assembly 30 and the second controls assembly 32 may be respectively positioned on inner portions of the first control strap 12 and the second control strap 14 that face the performer 10 to conceal the first controls assembly 30 and the second controls assembly 32 from the audience. The first controls assembly 30 and the second controls assembly 32 may each be designed or arranged to be actuated by a user's thumb in these embodiments. To avoid inadvertent interaction with the first controls assembly 30 (e.g., the first controls assembly 30 pressing against the performer 10 and causing unintended movement of the puppet 16), the first control strap 12 may include a first recessed portion 56 that is formed within a first body 58 (e.g., padding) of the first control strap 12. Similarly, the second control strap 14 may include a second recessed portion 60 formed within a second body 62 of the second control strap 14. The recessed portions 56, 60 may block the first controls assembly 30 and the second controls assembly 32 from contact with the performer 10 when the first control strap 12 and the second control strap 14 are worn as straps of the backpack 18 and abutting the performer 10. In other words, the recessed portions 56, 60 position the first controls assembly 30 and the second controls assembly 32 into the first control strap 12 and the second control strap 14, respectively. As such, the first controls assembly 30 and the second controls assembly 32 are not flush with surfaces of the bodies 58, 62 of the first control strap 12 and the second control strap 14, respectively. In order to interact with the first control strap 12 and/or the second control strap 14, the performer may utilize their hands to reach into the recessed portions 56, 60 and engage the first controls assembly 30 and the second controls assembly 32, respectively. The recessed portions 56, 60 reduce inadvertent actuation of the puppet 16, and thus, provide enhanced control of the puppet 16 by the performer 10. In some embodiments, the first and second control assemblies 30, 32 may be accessible from the front (or both the front and back) of the first and second control straps 12, 14. In some embodiments, themed material may be arranged to conceal interaction with the control assemblies 30, 32. In each embodiment, a recess (e.g., recessed portions 56, 60) may be employed to reduce the likelihood of inadvertent actuation during use. In a specific example, the control assemblies 30, 32 may be positioned in a middle portion of the respective control straps 12, 14 and accessible on either side (user-facing and user-opposing sides) via recesses.

Figure 3:
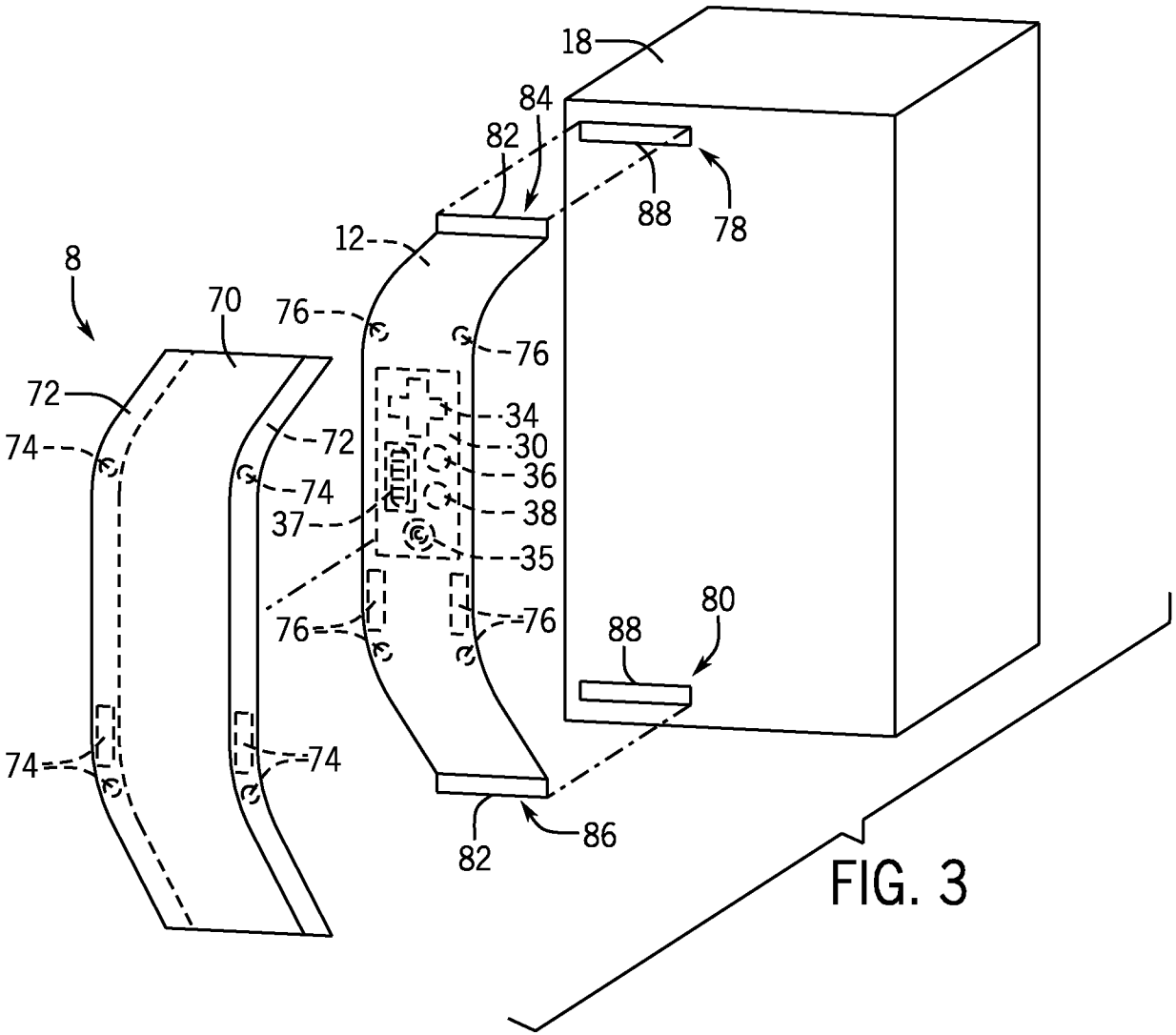
FIG. 3 is an exploded perspective view of an embodiment of the character control system, in accordance with aspects of the present disclosure.

As set forth above, the first control strap 12 and the second control strap 14 may be interchangeable between props, such as the backpacks 18, 20, 22. Therefore, the first control strap 12 and/or the second control strap 14 may include covers that are configured to enable the first control strap 12 and/or the second control strap 14 to imitate a theme of, and thus be utilized with, various props. For example, FIG. 3 is an exploded perspective view of the first control strap 12, the backpack 18, and a cover 70. The cover 70 may include a pattern, print, and/or other aesthetic features that are consistent with a theme of the backpack 18. The cover 70 is configured to be disposed over and conceal the first control strap 12 to enable the first control strap 12 to be utilized with a variety of different themes. As such, the first control strap 12 may be formed from a generic material that may be concealed by the cover 70 for use with multiple props, costumes, and/or uniforms. Extra themed material may be positioned relative to the control straps 12, 14 to further conceal activity. For example, a flap of material may extend over the area proximate the control assemblies 30, 32 to hide hand movement during actuation of the control assemblies 30, 32.

In some embodiments, the cover 70 includes flaps 72 (e.g., folds) that are configured to wrap around and/or couple to the first control strap 12. The flaps 72 may include fasteners 74 (e.g., snaps, Velcro, zippers, and/or buttons) that engage corresponding fasteners 76 of the first control strap 12 to secure the cover 70 to the first control strap 12. As such, the cover 70 may enable the first control strap 12 to be utilized with a prop, costume, and/or uniform that is consistent with a theme of the puppet 16. Different covers 70 may be coupled to the first control strap 12, thereby enabling the first control strap 12 to be used with a variety of different themes.

As shown in the illustrated embodiment, the first control strap 12 may be secured to the backpack 18 at a first interface 78 and a second interface 80. In some embodiments, the first control strap 12 may include male plugs 82 at a first end 84 and a second end 86 of the first control strap 12. The male plugs 82 may be configured to be inserted into female receptacles 88 of the backpack 18 at the first interface 78 and the second interface 80. The male plugs 82 may include the first connector 52 and the female receptacles 88 of the backpack 18 may be configured to communicatively couple the first controls assembly 30 to the puppet 16. As such, the first control strap 12 may be connected to the backpack 18 via the interfaces 78, 80, and the cover 70 may be disposed over the first control strap 12 to enable the performer 10 to begin controlling the puppet 16. In other embodiments, the first control strap 12 may be coupled to the backpack 18 in another suitable manner (e.g., buckles, clasps, and/or snaps). As should be understood, the backpack 18 may include corresponding interfaces for the second control strap 14, which may be coupled to the backpack 18 in generally the same manner as the first control strap 12. In other embodiments, rather than male connectors (e.g., male plugs 82), female connectors may be employed, and rather than female connectors (e.g., female receptacles 88), male connectors may be employed. Further, rather than the first strap 12 and the second strap 14 having corresponding interfaces, the interfaces may be opposite to create a polka yoke configuration. For example, the first strap 12 may include two male connectors and the second strap 14 may include two female connectors to avoid mistakenly connecting them in an improper arrangement.

Figure 4:
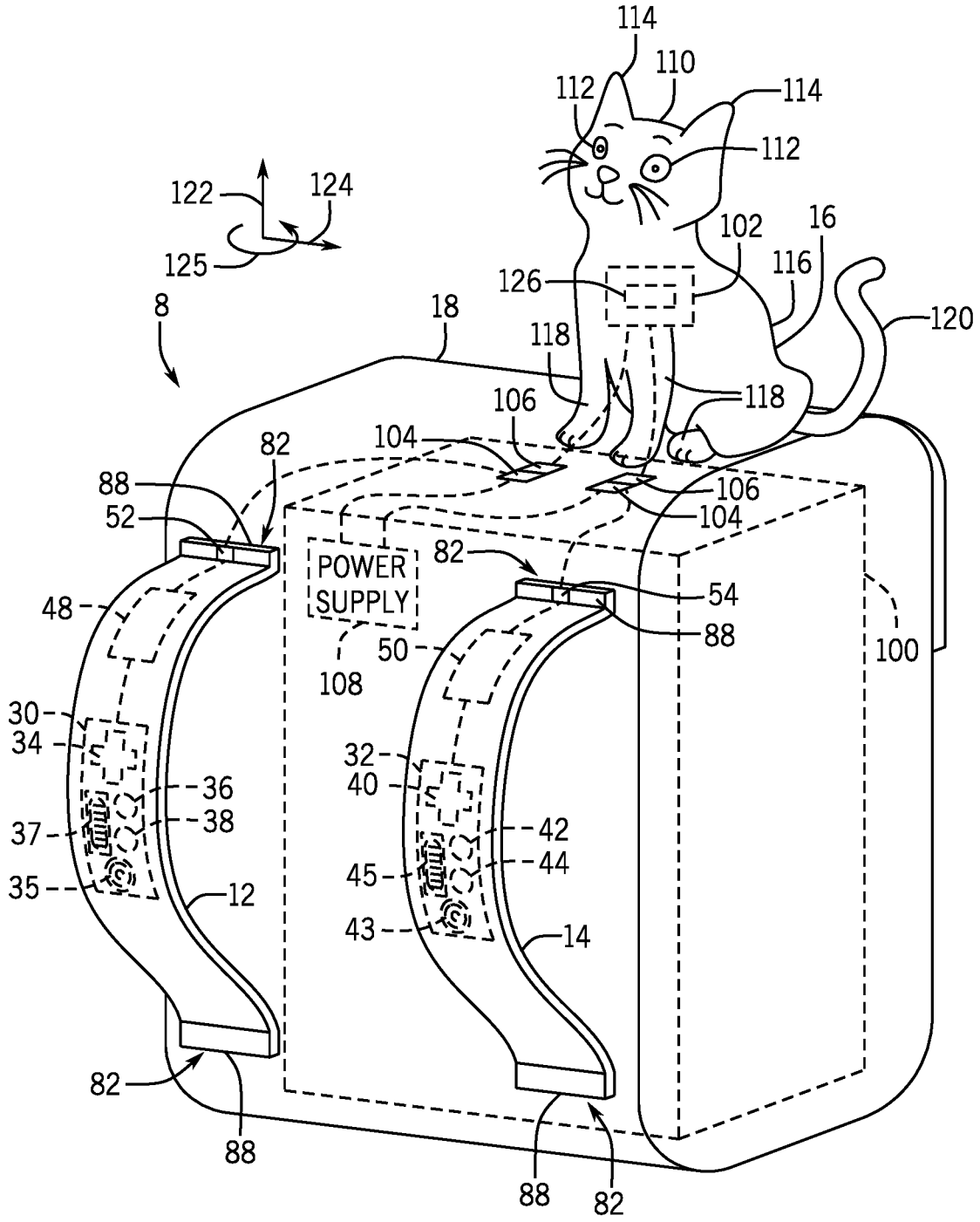
FIG. 4 is a perspective view of an embodiment of the character control system, in accordance with aspects of the present disclosure.

For example, FIG. 4 is a perspective view of an embodiment of the first control strap 12, the second control strap 14, and the puppet 16 coupled to the backpack 18. As shown in the illustrated embodiment of FIG. 4, the puppet 16 may be supported by the backpack 18. In some embodiments, the backpack 18 may include a frame 100 that may provide support to the puppet 16 and/or enable the backpack 18 to appear full. In other embodiments, the puppet 16 may be configured to be directly supported by the performer 10 (e.g., via a shoulder mount) and/or supported by another prop carried and/or worn by the performer 10. For example, in one embodiment, the body of the backpack may be themed to look like a body of the puppet 16.

The puppet 16 may include actuators 102 configured to control movement of various portions or parts of the puppet 16. The actuators 102 may be coupled (e.g., wired or wirelessly) to the controllers 48, 50. Specifically, for example, the actuators 102 may include a wireless transmitter and/or receiver that may be communicatively coupled to a corresponding wireless transmitter and/or receiver of the controllers 48, 50. In some embodiments, the corresponding wireless transmitter and/or receiver of the controllers 48, 50 may be coupled to the female receptacles 88 within the backpack 18. In other embodiments, the corresponding wireless transmitter and/or receiver of the controllers 48, 50 is within the control straps 12, 14. In some embodiments, the backpack may include additional female receptacles 104 that are configured to receive additional male plugs 106 of the puppet 16. The additional male plugs 106 may be coupled to the actuators 102, and thus, establish a connection between the first controls assembly 30, the second controls assembly 32, and the actuators 102 via the male plugs 82, the female receptacles 88, and/or additional female receptacles 104. As with all referenced connectors, in other embodiments female and male connectors may be interchangeable.

Further, in some embodiments, the first control strap 12, the second control strap 14, the puppet 16, and/or the backpack 18 may include a power supply 108 that is configured to provide electrical power to the actuators 102 and ultimately drive movement of the puppet 16, emit audio from the puppet 16, and/or generate an effect of the puppet 16. The power supply 108 may include a battery that is disposed within a portion of the first control strap 12, the second control strap 14, the puppet 16, and/or the backpack 18, and thus, concealed from the audience. The power supply 108 may represent multiple power supplies that may be distributed throughout the character control system 8 and that may cooperate to provide additional and/or redundant power. The power supply 108 may provide electrical power to the first controls assembly 30, the second controls assembly 32, the first controller 48, the second controller 50, and/or another suitable component in addition to the actuators 102. In other embodiments, the character control system 8 may include multiple distinct power sources (e.g., a power source for each of the first control strap 12, the second control strap 14, the puppet 16, and/or the backpack 18).

As shown in the illustrated embodiment of FIG. 4, the puppet 16 may be a cat, which may include a head 110, eyes 112, ears 114, a torso 116, legs 118, and a tail 120. In some embodiments, the actuators 102 may be configured to move the head 110 along a first axis 122, move the head 110 along a second axis 124, and/or to rotate the head 110 in a circumferential direction 125 about the first axis 122. For example, the control pad 34 may be used to move the head along the first axis 122 and the second axis 124, and the control pad 40 may be used to rotate the head about the first axis 122. Further still, the actuators 102 may be configured to move the eyes 112 (e.g., cause the eyes 112 to blink) and/or the ears 114 (e.g., move the ears 114 back and forth to cause a wiggle motion) via a push of one of the buttons 36, 38, 42, 44. As set forth above, the buttons 36, 38, 42, 44 may be utilized to enable the control pads 34, 40 to switch control from the head 110 to the torso 116, the legs 118, and/or the tail 120. Additionally or alternatively, the buttons 36, 38, 42, 44 may actuate a speaker 126 included in the puppet 16 in order to emit a sound (e.g., a purr) from the puppet 16.

Accordingly, the performer 10 may utilize the first controls assembly 30 and the second controls assembly 32 to cause the puppet 16 to move, emit a sound, and/or generate another effect via the actuators 102. The control of the puppet 16 by the performer 10 is generally concealed from the audience because the first controls assembly 30 and the second controls assembly 32 are facing toward the performer and hidden from a view of the audience. In other embodiments, different concealment techniques (e.g., themed material that covers the user's hands near the control assemblies 30, 32) may be included. Thus, while it may appear that the performer 10 is holding straps of the backpack 18, the performer 10 may be controlling motion of the puppet 16.

While only certain features of the disclosed embodiments have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A character control system, comprising:

a strap configured to removably couple to a prop configured to be transported by a performer;

a controls assembly disposed within a portion of the strap, wherein the controls assembly comprises a plurality of control features; and a controller configured to couple to the controls assembly and a plurality of actuators of a puppet, wherein the controller is configured to control the plurality of actuators to move a plurality of parts of the puppet in response to actuation of the plurality of control features and wherein a connector is configured to removably couple the plurality of actuators of the puppet to the controls assembly.

2. The character control system of claim 1, comprising the prop, and wherein the prop is a backpack.

3. The character control system of claim 2, comprising a power source, wherein the power source is disposed within a compartment of the backpack.

4. The character control system of claim 2, wherein the backpack comprises a frame configured to support the puppet.

5. The character control system of claim 1, comprising a cover configured to at least partially surround the strap, wherein the cover is consistent with a theme of the prop.

6. The character control system of claim 5, wherein the cover comprises first fasteners configured to couple to corresponding second fasteners of the strap.

7. The character control system of claim 1, wherein the plurality of control features of the controls assembly comprises a control pad, one or more buttons, or both.

8. The character control system of claim 1, wherein the controls assembly is disposed within a recessed portion of the strap, such that the controls assembly is not flush with a surface of the strap.

9. The character control system of claim 1, wherein the controller is disposed within an additional portion of the strap.

10. The character control system of claim 9, wherein the controller is configured to couple to at least one actuator of the plurality of actuators via a male plug configured to extend through the prop and to be received by a female receptacle of the at least one actuator of the plurality of actuators.

11. A wearable puppeteering system comprising:

a backpack;

a puppet integrated with the backpack and comprising a first actuator and a second actuator, wherein the first actuator is configured to move a first part of the puppet and the second actuator is configured to move a second part of the puppet;

a first strap of the backpack comprising a first control assembly, wherein the first control assembly is configured to control the first actuator; and a second strap of the backpack comprising a second control assembly, wherein the second control assembly is configured to control the second actuator.

12. The wearable puppeteering system of claim 11, wherein the first actuator is configured to adjust a position of a head of the puppet.

13. The wearable puppeteering system of claim 12, wherein the second actuator is configured to move an arm or leg of the puppet.

14. The wearable puppeteering system of claim 11, wherein:

the first control assembly comprises a control pad; and the control pad comprises a set of directional buttons.

15. A wearable puppet control system, comprising:

a puppet comprising a plurality of actuators, wherein a first actuator of the plurality of actuators is configured to move a first part of the puppet, wherein a second actuator of the plurality of actuators is configured to move a second part of the puppet; and a strap configured to support the wearable puppet control system on a user and comprising a control assembly, wherein the control assembly comprises:

a control pad configured to control the first actuator or the second actuator;

a first button configured to enable the control pad to control the first actuator; and a second button configured to enable the control pad to control the second actuator.

16. The wearable puppet control system of claim 15, comprising a controller configured to cause the puppet to follow a predetermined or preprogrammed sequence.

17. The wearable puppet control system of claim 16, comprising a third button, wherein the controller is configured to cause the puppet to follow the predetermined or preprogrammed sequence in response to selection of the third button.

18. The wearable puppet control system of claim 16, wherein the controller is configured to cause the puppet to follow the predetermined or preprogrammed sequence in response to a threshold time of inactivity.

19. The wearable puppet control system of claim 15, wherein the puppet is configured to be interchangeable with another puppet.

* * * * *